US012448851B2

(12) United States Patent
Alsharif

(10) Patent No.: US 12,448,851 B2
(45) Date of Patent: Oct. 21, 2025

(54) REAMING A WELLBORE

(71) Applicant: Saudi Arabian Oil Company, Dhahran (SA)

(72) Inventor: Mohammed T. Alsharif, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 21 days.

(21) Appl. No.: 18/185,905

(22) Filed: Mar. 17, 2023

(65) Prior Publication Data

US 2024/0309706 A1 Sep. 19, 2024

(51) Int. Cl.
*E21B 10/32* (2006.01)
*E21B 7/04* (2006.01)
*E21B 47/02* (2006.01)

(52) U.S. Cl.
CPC ..... *E21B 10/322* (2013.01); *E21B 7/046* (2013.01); *E21B 47/02* (2013.01)

(58) Field of Classification Search
CPC ..... E21B 10/322; E21B 7/046; E21B 47/02
See application file for complete search history.

(56) References Cited

U.S. PATENT DOCUMENTS 1,559,761 A * 11/1925 Nebergall ..... E21B 10/327 175/267
6,360,831 B1 * 3/2002 Akesson ..... E21B 10/322 175/269
9,879,518 B2 1/2018 May
2008/0128174 A1 * 6/2008 Radford ..... E21B 10/322 166/383
2010/0282511 A1 * 11/2010 Maranuk ..... E21B 10/322 175/344
2013/0292175 A1 * 11/2013 Radford ..... E21B 10/32 175/263
2014/0262525 A1 * 9/2014 Fuller ..... E21B 10/322 175/57
2015/0101864 A1 * 4/2015 May ..... E21B 10/32 175/27
2016/0237811 A1 * 8/2016 Reed ..... E21B 47/00

* cited by examiner

*Primary Examiner* — Nicole Coy
*Assistant Examiner* — Jennifer A Railey
(74) *Attorney, Agent, or Firm* — Fish & Richardson P.C.

(57) ABSTRACT

Implementations of the present disclosure include a drilling assembly that includes a drill string, one or more sensors, and a reamer assembly. The sensors detect at least one parameter of the drill string or wellbore. The reamer assembly has a housing, at least one movable reamer pads, and a valve. The housing defines a cavity arranged to receive fluid from the drill string. The at least one movable reamer pad is at least partially disposed within the cavity. The valve is operable to regulate, as a function of feedback from the sensors, a flow of fluid into the cavity, allowing the fluid to contact the at least one movable reamer and push the at least one movable reamer pad from a first position, in which the at least one reamer pad is retracted, to a second position in which the at least one reamer pad is expanded.

19 Claims, 4 Drawing Sheets

REAMING A WELLBORE

FIELD OF THE DISCLOSURE

This disclosure relates to wellbore equipment, and more particularly to reaming equipment and operations.

BACKGROUND

Wellbore drilling is the process of drilling a hole from the Earth surface into a subterranean zone. During drilling operations, the drill string can use boring and reaming equipment to bore and ream the wellbore for smoothening the hole profile. Boring and reaming a wellbore can help the drilling process and can help prepare the wellbore for casing installation. Methods and equipment to improve drilling operations are sought.

SUMMARY

Implementations of the present disclosure include a drilling assembly that includes a drill string, one or more sensors, and a reamer assembly. The drill string has a drill bit to drill a wellbore. The drill string forms, with the drill string disposed within the wellbore, an annulus defined between an outer wall of the drill string and the wall of the wellbore. The one or more sensors are coupled to the drill string. The one or more sensors detect at least one parameter of the drill string or of the wellbore. The reamer assembly is coupled to the drill string uphole of the drill bit. The reamer assembly has a housing, at least one movable reamer pads, and a valve. The housing defines a cavity arranged to receive fluid from the drill string. The at least one movable reamer pad is at least partially disposed within the cavity. The valve is coupled to the housing and is operable to regulate, as a function of feedback from the one or more sensors, a flow of fluid into the cavity, allowing the fluid to contact the at least one movable reamer and push the at least one movable reamer pad from a first position, in which the at least one reamer pad is retracted and the reamer assembly defines a first reaming diameter, to a second position in which the at least one reamer pad is expanded and the reamer assembly defines a second reaming diameter greater than the first reaming diameter.

In some implementations, the reamer assembly further includes a controller operationally coupled to the valve. The controller controls, as a function of feedback from the one or more sensors, the valve to regulate the flow of fluid into the cavity.

In some implementations, the drilling assembly further includes a system including one or more computers in one or more locations. The system is electrically coupled to the one or more sensors and receives feedback from the sensors, determines, based on the sensor feedback, a dogleg severity of the wellbore, determines, based on the determined dogleg severity, a command, and transmits the command to the controller for the controller to control the valve to regulate the flow of fluid into the cavity and move the at least one reamer pad to the first position or the second position.

In some implementations, the controller selectively expands the one or more reamer pads to two or more positions by controlling the valve to allow a predetermined amount of fluid into the cavity. The predetermined amount of fluid is associated with a preselected reaming diameter of the reamer assembly. In some implementations, the controller is configured to selectively expand the one or more reamer pads to form a plurality of reaming diameters between the first position and the second position.

In some implementations, the drilling assembly further includes a valve configured to regulate a fluid pressure in the cavity by regulating a flow of fluid out of the fluid cavity and into the annulus. In some implementations, the valve includes a passive bypass valve configured to depressurize the fluid cavity.

In some implementations, the fluid expands a volume defined between a lower surface of the at least one reamer pad and a base of the cavity to move the reamer pad away from the base of the cavity to the second position.

Implementations of the present disclosure include a reamer assembly that includes a housing, at least one movable rib, and a valve. The housing is coupled to a drill string uphole of a drill bit of the drill string. The housing defines a cavity that receives fluid from the drill string. The at least one movable rib is at least partially disposed within the cavity. The valve is coupled to an inlet of the cavity and is operable to regulate, as a function of feedback from one or more sensors of the drill string, a flow of fluid into the cavity. The cavity includes a volume that is defined between a lower surface of the movable rib and a bottom surface of the cavity. The valve allows the fluid to fill the cavity and expand the volume, pushing the at least one movable rib to increase a reaming diameter of the at least one movable rib.

Implementations of the present disclosure include a method that includes receiving, by a system including one or more computers in one or more locations, sensor feedback from one or more sensors coupled to a drill string. The method also includes determining, by the system and as a function of the sensor feedback, controller instructions. The method also includes transmitting, by the system and to a controller operationally coupled to a valve coupled to a cavity of a reamer assembly including a movable rib, the controller instructions, causing the controller to open the valve and allow fluid to fill the cavity and expand a volume defined between a lower surface of the movable rib and a bottom surface of the cavity, pushing the at least one movable rib to increase a reaming diameter of the at least one movable rib.

In some implementations, the method also includes determining, by the system and based on the sensor feedback, a dogleg severity of the wellbore. The method also includes determining, by the system and based on the determined dogleg severity, second instructions, and transmitting, by the system and to the controller, the second instructions for the controller to control the valve to regulate the flow of fluid into the cavity.

In some implementations, the controller is configured to selectively expand the one or more reamer pads to two or more positions by controlling the valve to allow a predetermined amount of fluid into the cavity, and transmitting the second instructions includes transmitting instructions to open the valve a predetermined amount associated with the dogleg severity. In some implementations, the controller is configured to selectively expand the one or more reamer pads to form a plurality of reaming diameters between the first position and the second position.

BRIEF DESCRIPTION

DETAILED DESCRIPTION

The present disclosure relates to methods and equipment for drilling using a drilling assembly that has one or more "smart reamers." The drill string can be used with geo steering to drill non-vertical wellbores. The smart reamer can be a dog leg reamer for smoothening the hole profile while geo steering through the horizontal section of a wellbore. During geo steering, changes in well path can result in localized micro dog legs that can be missed by conventional dog leg reamers as ledges. Hence, no smoothening action is acted upon these intervals. Reaming with a conventional dog leg reamers can result in a unified wellbore diameter, but often with tortious interval. The smart reamer can be activated or expanded against ledges when these ledges are identified by the measurement while drilling (MWD) tool, smoothening the wellbore uniformly and reducing or elimination torturous intervals.

Particular implementations of the subject matter described in this specification can be implemented so as to realize one or more of the following advantages. For example, smart reamer can be expanded to multiple outer diameters to provide the required smoothening action needed for different sections of the wellbore. Additionally, the intelligent dog leg reamer can use feedback from conventional MWD tools to evaluate the overall interval tortuousness and provide required smoothening action to reduce or eliminate tortuousness resulted from the geo steering effect throughout the whole interval. The drilling assembly can be used in different wellbore operations, such as drilling, cementing, cleaning, and remediating a wellbore.

Figure 1:
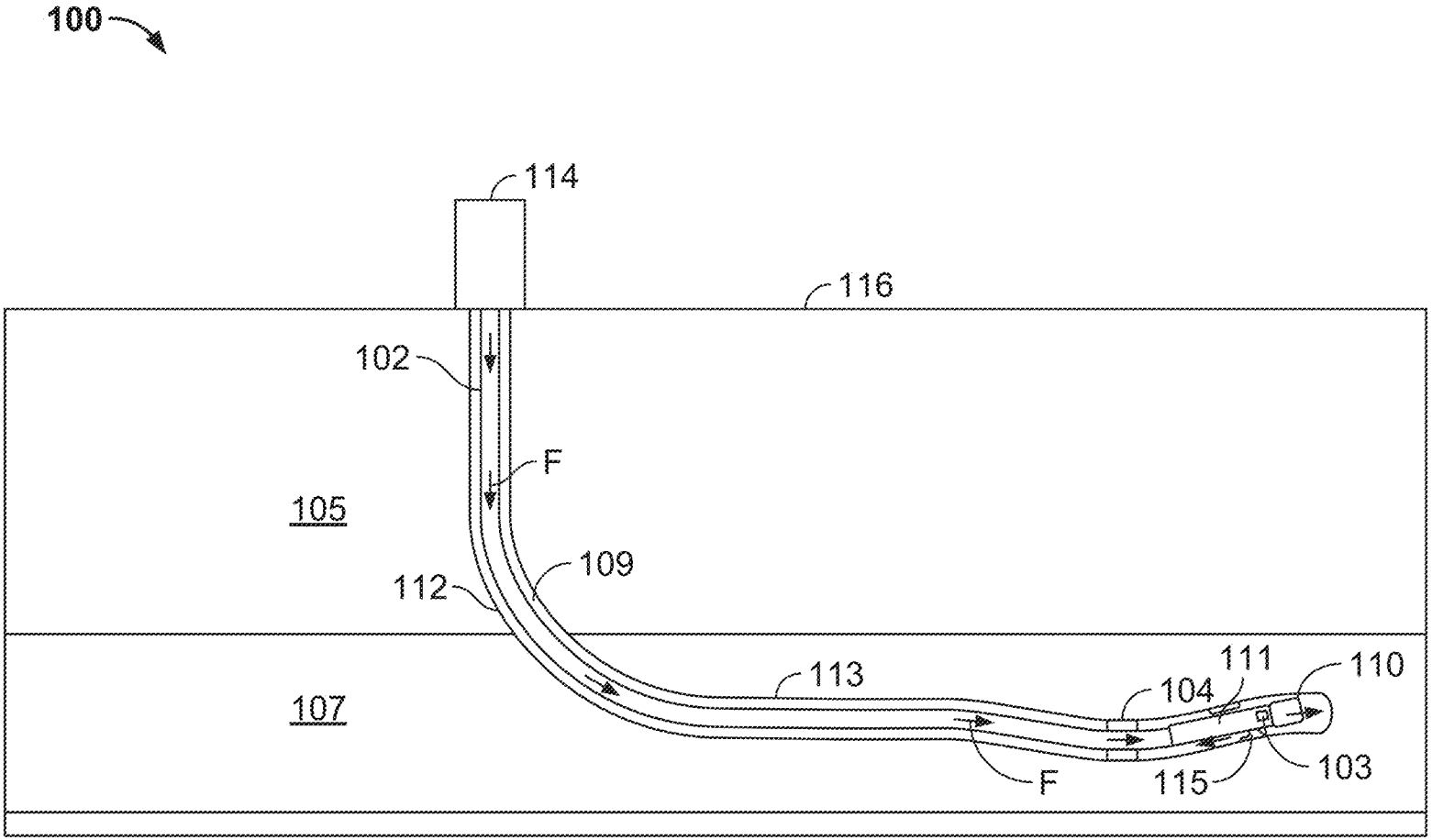
FIG. 1 is a schematic front view, cross-sectional, of a drilling assembly.

FIG. 1 shows a drilling assembly 100 utilized to drill a wellbore 112 formed in a geologic formation 105. The geologic formation 105 includes a hydrocarbon reservoir 107 from which hydrocarbons can be extracted. The wellbore extends from a surface (e.g., a terrancan surface) 116 to a downhole end of the wellbore. The wellbore 112 is a non-vertical wellbore with a non-vertical or horizontal section 113. The horizontal section 113 can extend through or along the hydrocarbon reservoir 107.

The drilling assembly 100 includes a drill string 102, one or more sensors 103, and a reamer assembly 104 (e.g., a smart reamer). The drill string 102 is attached to surface equipment 114 such as a derrick or a crane or a truck that holds and drives the drill string 102. The drill string 102 drills through the formation 105 to define an annulus 109 between an outer wall of the drill string and the wall of the wellbore. The drill string 102 can be a directional drilling drill string with geo steering capabilities. The drill string 102 has a drill bit 110 that is rotated to drill the wellbore 112. The drill string 102 directs a drilling fluid "F" (e.g., drilling mud) downhole and out the drill bit 110. The drilling fluid "F" then flows up the annulus 109 to the surface 116 of the wellbore 112. The drilling fluid "F" helps cool the drilling equipment and clean up the wellbore 112 during drilling. As further described in detail below, the drilling fluid "F" expands or activates the reamer assembly 104 to selectively ream the wellbore 112.

The one or more sensors 103 detect at least one parameter of the drill string or of the wellbore. For example, the sensors 103 can sense, without limitation, a change in the inclination/angle of the drill string 102 or the wellbore 112, the azimuth of wellbore 112, and the speed of the drill string (or the rate of penetration). The sensors 103 can be part of a measurement while drilling (MWD) tool 111. The MWD tool 111 can be part of a bottom hole assembly (BHA).

The reamer assembly 104 is disposed uphole of the drill bit 110. For example, the reamer assembly 104 can reside uphole of the drill string and the MWD tool 111. In some implementations, the reamer assembly 104 can be part of the BHA. As further described in detail below with respect to FIGS. 2-4, the reamer assembly 104 has movable reamer pads or ribs that selectively movable to ream the horizontal section 113 of the wellbore 112 to smooth ledges 115 that may or may not be associated with dog legs.

A dog leg (or dogleg) is referred to herein as a particularly crooked place or section in a wellbore where the trajectory of the wellbore in three-dimensional space changes rapidly or more than anticipated or desired, which can change the path of the wellbore. In surveying wellbore trajectories, a standard calculation of dogleg severity can be expressed in two-dimensional degrees per unit of wellbore length (e.g., 100 feet or 30 meters of wellbore length). Localized micro dog legs can be small or subtle which will not be seen by DL reamer as ledges. Doglegs mainly affect completion deployment operation. For example, after the section is drilled, the well is completed by running tubing that may be less stiff than the drill string. Thus, running completion through a tortuous hole (hole with high dogleg severity) can be challenging and can damage the tubing components.

The dog leg severity can be measured through the change in the inclination, and/or azimuth of a borehole and can be expressed in degrees per 100 feet of course length. Dog leg severity can be measured by utilizing the MWD tool 111, which considers the drill string position in term of azimuth and inclination. Dog leg severity (DLS) can be determined as a function of inclination, distance between surveys, and direction at upper and lower surveys. Once an "out of range" DLS is flagged (e.g., a measured DLS that satisfies a DLS threshold), the sensors of the MWD tool 111 records the measured depth (MD) of that interval. Then, considering the drilling rate of penetration, once the first reamer approaches the tortious interval, the MWD tool or the controller sends a command to activate the reamer pad to be worked across the tortuous interval. If the drill string has multiple smart reamers, the activation process can be repeated when the second, third, and subsequent reamers approach the tortious interval.

Tortuosity is referred to herein as a description of the wellbore trajectory or the amount by which the actual wellbore deviates from the planned trajectory. The reamer assembly 104 is activated to smooth these dog legs and reduce or eliminate tortuous intervals. Thus, the reamer assembly not only creates a wellbore of uniform or unified diameter, but a wellbore without (or with reduced) tortious intervals.

Figure 2:
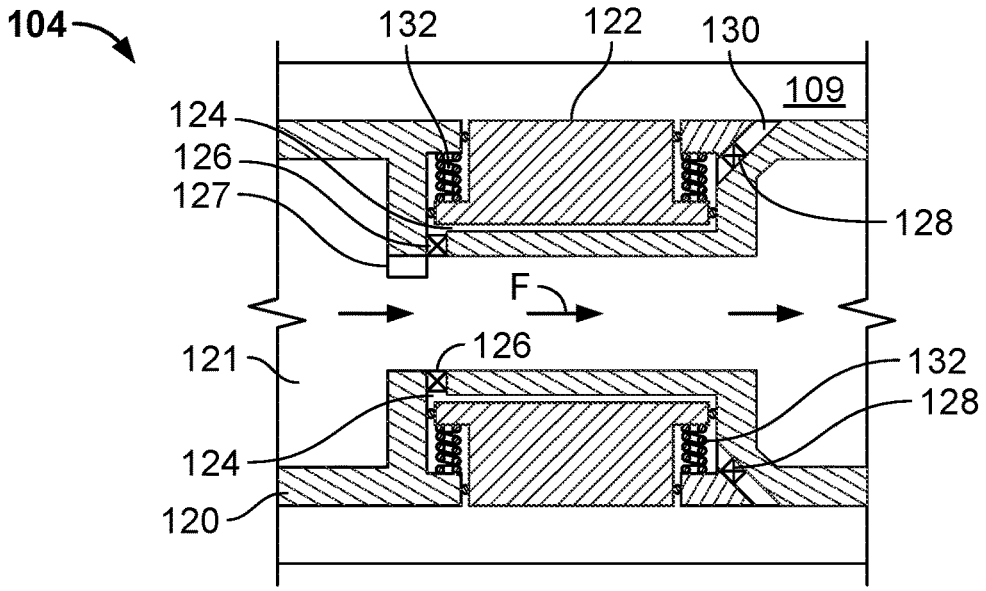
FIGS. 2-4 are sequential, cross-sectional, schematic views of a reamer assembly.

Referring now to FIG. 2, the reamer assembly 104 has a housing 120 that defines one or more cavities 124 arranged to receive the drilling fluid "F" (or a different fluid) from the drill string. The housing 120 is attached (e.g., threadedly coupled) to the drill string. For example, the housing 120 can be a tube or a sub residing between two drill pipes of the drill string. The housing 120 has reduced dimeter where the cavity 124 is defined. Each cavity 124 stores or houses a movable reamer pad 122. For example, the housing 120 can have two cavities 124 and each cavity houses a reamer pad 122 so that the reamer assembly 104 has two reamer pads 122. Each reamer pad 122 is at least partially disposed within its respective cavity 124 and out of the cavity when expanded.

The reamer assembly also has at least one first valve 126 (e.g., an inlet valve) and at least one second valve 128 (e.g., a bypass valve). For example, each cavity 124 is associated with a respective first valve 126 and a respective second valve 128. The first valve 126 is coupled to the housing and is operable to regulate, as a function of feedback from the one or more sensors 103 (see FIG. 1), a flow of fluid "F" into the cavity 124.

Figure 3:
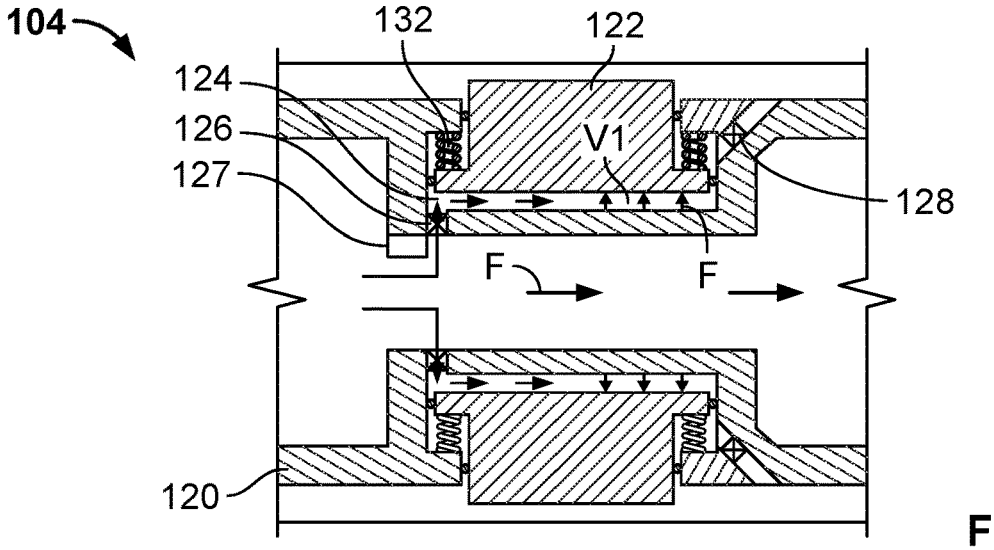
Figure 4:
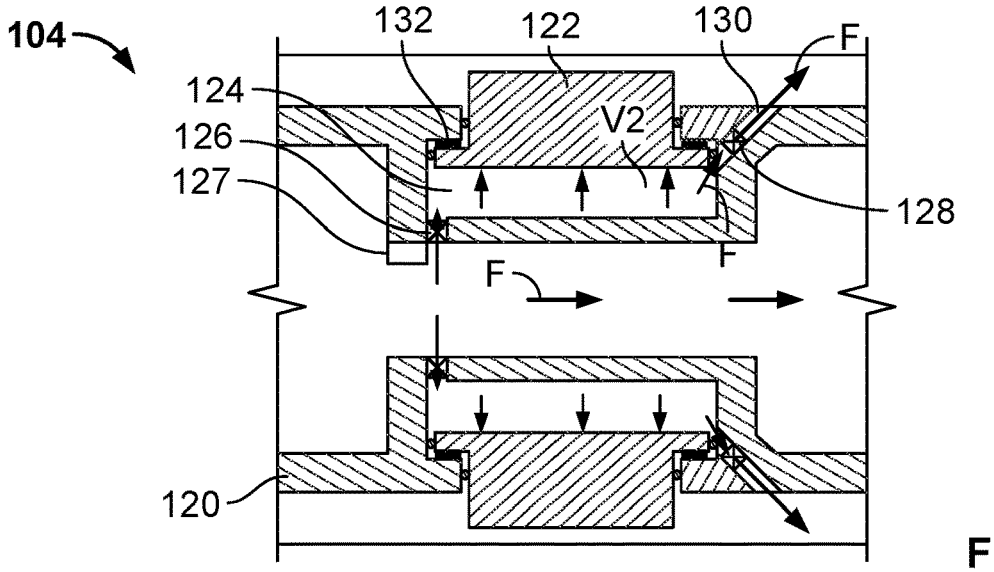

Also referring to FIGS. 3 and 4, the first valve 126 opens to allow the fluid "F" to contact and push the reamer pad 122 from a first position, in which the reamer pad 122 is retracted (as shown in FIG. 2), to a second position in which the reamer pad 122 is expanded (as shown in FIG. 4) or partially expanded (as shown in FIG. 3). In the first position, the reamer assembly 104 has a first reaming diameter, and a second reaming diameter in the second position, with the second reaming diameter being larger than the first reaming diameter.

As shown in FIG. 2, each inlet valve 126 is controlled by a controller 127. The controller 127 can be part of the reamer assembly 104 (e.g., coupled or the housing 120) or it can reside somewhere else, such as at the terranean surface of the wellbore or at the MWD tool 111 (see FIG. 1). The controller 127 is coupled (e.g., operationally coupled) to and controls the valve 126 as a function of feedback from the MWD sensors 103 to selectively expand and retract the reamer pads 122. For example, the controller 127 uses the sensor feedback to regulate the flow of fluid into the cavity. The controller 127 can determine how much fluid "F" should enter the cavity 124 to expand the reamer pads 122 to a desired reaming diameter. For example, the controller can associate an amount of fluid in the cavity 124 with a reaming diameter of the reamer assembly 104, and control the valve 126 accordingly. The controller can determine how much fluid there is in the cavity as a function of how long or wide the valve 126 was opened. Additionally, the cavity 124 or housing 120 can have sensors (not shown) that the controller uses to determine the amount of fluid in the cavity 124.

Thus, the controller 127 selectively expands the reamer pads 122 to two or more positions by controlling the valve 126 to allow a predetermined amount of fluid into the cavity 124. The predetermined amount of fluid "F" is associated with a preselected reaming diameter of the reamer assembly 104. Additionally, the controller 127 allows fluid to push the reamers to form multiple reaming diameters (e.g. multiple reaming diameters between the first position and the second position), not just two positions (retracted and expanded).

The controller 127 can be coupled to the multiple inlet valves 126 or each valve can be controlled by a respective controller 127. In some implementations, the controller 127 can be implemented as a distributed computer system disposed partly at the reamer assembly 104 and partly at the MWD tool 111. The computer system can include one or more processors or computers in one or more locations. The computer system also includes a computer-readable medium storing instructions executable by the one or more processors to perform the operations described here. In some implementations, the controller 127 can be implemented as processing circuitry, firmware, software, or combinations of them. The controller 127 can transmit signals to the valve 126 to selectively change the reaming diameter of the reamer assembly 104.

To determine how much fluid to let into the cavity, the controller 127 (or the MWD tool 111 or both) can determine a dogleg severity of the wellbore. For example, the computer system (or controller) includes or is electrically coupled to the one or more sensors 103. The controller receives feedback (e.g., real-time or near real-time feedback) from the sensors and determines, based on the sensor feedback, a dogleg severity of the wellbore. Then, the controller determines, based on the determined dogleg severity, a command or instructions to move the valve 126. The instructions can be used to control the valve 126 or to be transmitted to another controller for the controller to control the valve 126. The controller 127 can control, as a function of dog leg severity, the valve 126 to regulate the flow of fluid into the cavity 124. For example, the controller 127 can open the valve a predetermined amount associated with the dogleg severity. For example, the greater the dog leg severity, the longer the controller 127 opens the valve 126 to let more fluid enter the cavity 124 to eliminate the micro dog leg resulted from geo steering.

Each reamer pad 122 is held in the retracted position by a compression spring 132 that pushes the spring against the bottom or base of the cavity 124. The spring is compressed when fluid "F" at a sufficient pressure enters the cavity 124. For example the fluid "F" can enter the cavity 124 and push the reamer pad 122 with an outward force that exceeds the inward force with which the spring 132 biases the reamer pad. In other words, as shown in FIGS. 3 and 4, the fluid "F" expands a volume of the cavity 124 from a first volume "V1" to a second volume "V2." The volume of the cavity is defined between a lower surface of the reamer pad 122 and a base of the cavity 124. The volume is expanded under fluid pressure to move the reamer pad like a hydraulic piston away from the base of the cavity 124 to the second position.

Referring back to FIG. 2, the second valve 128 regulates a fluid pressure in the cavity by regulating a flow of fluid out of the fluid cavity and into the annulus 109. The valve 128 can be a passive bypass valve that depressurizes the fluid cavity 124. For example, the valve 128 is disposed in a fluid channel 130 that, when the valve 128 is opened, fluidly couples the cavity 124 to the annulus 109. As shown in FIGS. 2 and 3, the fluid channel 130 is not exposed to the fluid "F" from the cavity when the reamer pad 122 is retracted (or partially retracted). As shown in FIG. 4, the fluid channel 130 is exposed and receives the fluid "F" from the cavity 124 when the reamer pad 122 is expanded (or partially expanded). The valve 128 can help depressurize the fluid cavity 124. For example, the valve 128 can depressurize the fluid cavity 124 when the fluid in the cavity 124 reaches a certain pressure, e.g., due to an excessive external force on the reamer pad 122 or too much fluid "F" entering the cavity 124 from the bore 121 of the reamer assembly 104.

Figure 5:
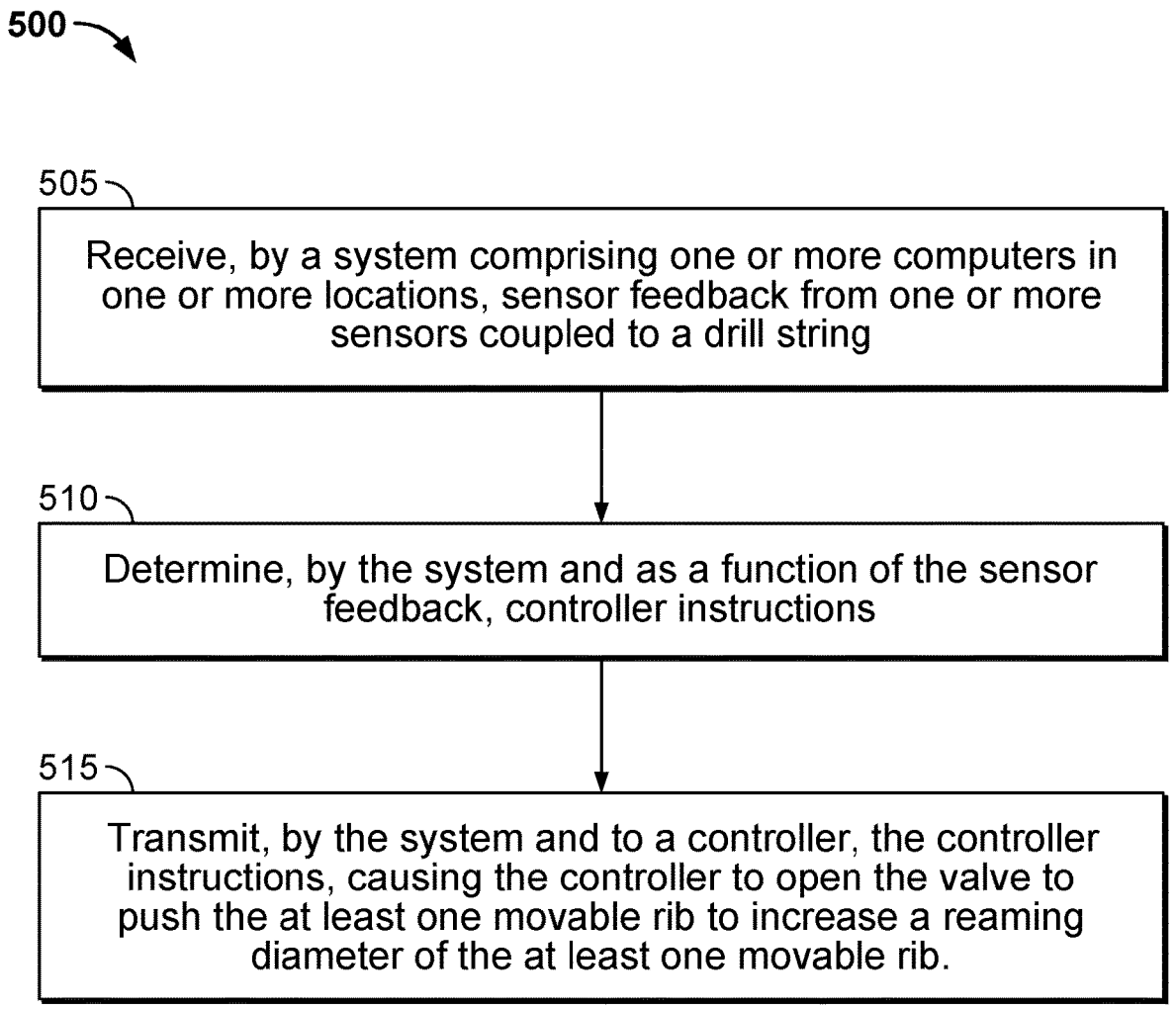
FIG. 5 is a flow chart of a method of reaming a wellbore.

FIG. 5 shows a flow chart of an example method 500 of reaming a wellbore. The method includes receiving, by a system including one or more computers in one or more locations, sensor feedback from one or more sensors coupled to a drill string 505. The method also includes determining, by the system and as a function of the sensor feedback, controller instructions (510). The method also includes transmitting, by the system and to a controller operationally coupled to a valve coupled to a cavity of a reamer assembly including a movable rib, the controller instructions, causing the controller to open the valve and allow fluid to fill the cavity and expand a volume defined between a lower surface of the movable rib and a bottom surface of the cavity, pushing the at least one movable rib to increase a reaming diameter of the at least one movable rib (515).

Figure 6:
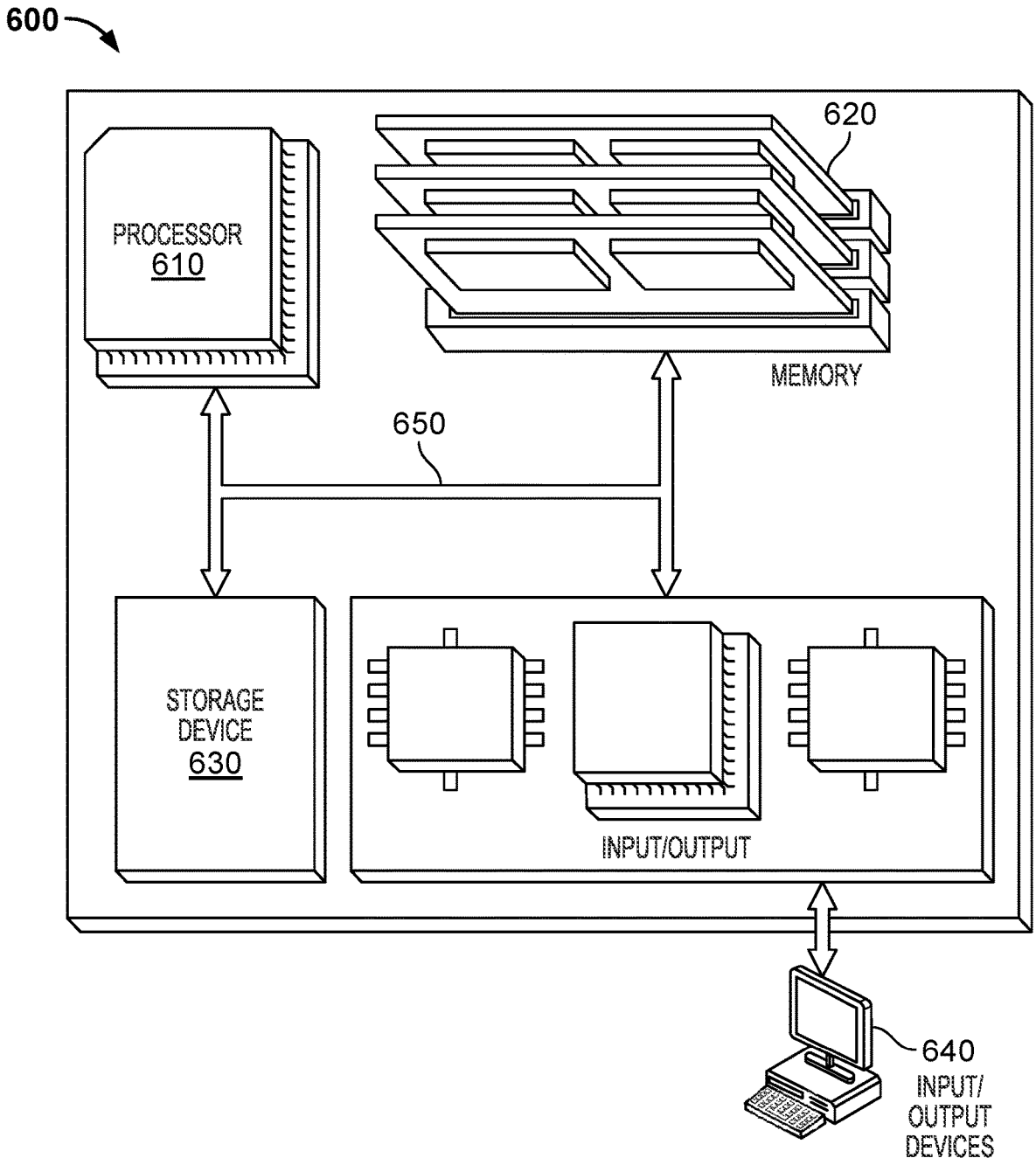
FIG. 6 is a schematic view of a control system according to an example embodiment of the present disclosure.

FIG. 6 is a schematic illustration of an example control system or controller for a reamer assembly according to the present disclosure. For example, the controller 600 may include or be part of the controller 127 shown in FIGS. 2-4. The controller 600 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 600 includes a processor 610, a memory 620, a storage device 630, and an input/output device 640. Each of the components 610, 620, 630, and 640 are interconnected using a system bus 650. The processor 610 is capable of processing instructions for execution within the controller 600. The processor may be designed using any of a number of architectures. For example, the processor 610 may be a CISC (Complex Instruction Set Computers) processor, a RISC (Reduced Instruction Set Computer) processor, or a MISC (Minimal Instruction Set Computer) processor.

In one implementation, the processor 610 is a single-threaded processor. In another implementation, the processor 610 is a multi-threaded processor. The processor 610 is capable of processing instructions stored in the memory 620 or on the storage device 630 to display graphical information for a user interface on the input/output device 640.

The memory 620 stores information within the controller 600. In one implementation, the memory 620 is a computer-readable medium. In one implementation, the memory 620 is a volatile memory unit. In another implementation, the memory 620 is a non-volatile memory unit.

The storage device 630 is capable of providing mass storage for the controller 600. In one implementation, the storage device 630 is a computer-readable medium. In various different implementations, the storage device 630 may be a floppy disk device, a hard disk device, an optical disk device, or a tape device.

The input/output device 640 provides input/output operations for the controller 600. In one implementation, the input/output device 640 includes a keyboard and/or pointing device. In another implementation, the input/output device 640 includes a display unit for displaying graphical user interfaces.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A drilling assembly, comprising:

a drill string comprising a drill bit configured to drill a wellbore, the drill string forming, with the drill string disposed within the wellbore, an annulus defined between an outer wall of the drill string and the wall of the wellbore;

one or more sensors configured to be coupled to the drill string, the one or more sensors configured to detect at least one parameter of the drill string or of the wellbore;

a reamer assembly configured to be coupled to the drill string uphole of the drill bit, the reamer assembly comprising:

a housing defining a cavity arranged to receive fluid from the drill string, at least one movable reamer pad configured to be at least partially disposed within the cavity, and a valve configured to be coupled to the housing, the valve operable to regulate, as a function of feedback from the one or more sensors, a flow of fluid into the cavity, allowing the fluid to enter the cavity underneath the reamer and contact the at least one movable reamer, allowing the fluid to fill a volume of the cavity and push the at least one movable reamer pad out of the cavity from a first position, in which the at least one reamer pad is retracted and the reamer assembly defines a first reaming diameter, to a second position in which the at least one reamer pad is expanded and the reamer assembly defines a second reaming diameter greater than the first reaming diameter;

wherein the drilling assembly further comprises a second valve configured to regulate a fluid pressure in the cavity by regulating a flow of fluid out of the fluid cavity and into the annulus.

2. The drilling assembly of claim 1, wherein the valve comprises a passive bypass valve configured to depressurize the fluid cavity.

3. The drilling assembly of claim 1, wherein the reamer assembly further comprises a controller operationally coupled to the valve, the controller configured to control, as a function of feedback from the one or more sensors, the valve to regulate the flow of fluid into the cavity.

4. The drilling assembly of claim 3, further comprising a system comprising one or more computers in one or more locations, the system electrically coupled to the one or more sensors and configured to:

receive feedback from the sensors, determine, based on the sensor feedback, a dogleg severity of the wellbore, determine, based on the determined dogleg severity, a command, and transmit the command to the controller for the controller to control the valve to regulate the flow of fluid into the cavity and move the at least one reamer pad to the first position or the second position.

5. The drilling assembly of claim 4, wherein the controller is configured to selectively expand the one or more reamer pads to two or more positions by controlling the valve to allow a predetermined amount of fluid into the cavity, the predetermined amount of fluid associated with a preselected reaming diameter of the reamer assembly.

6. The drilling assembly of claim 5, wherein the controller is configured to selectively expand the one or more reamer pads to form a plurality of reaming diameters between the first position and the second position.

7. The drilling assembly of claim 1, wherein the fluid expands a volume defined between a lower surface of the at least one reamer pad and a base of the cavity to move the reamer pad away from the base of the cavity to the second position.

8. The drilling assembly of claim 1, wherein the at least one movable reamer pad is spring-loaded by a spring pushing the reamer toward a base of the cavity, and the fluid directly pushes the at least one movable reamer pad to compress the spring as the volume of the cavity expands.

9. The drilling assembly of claim 1, wherein the at least one movable reamer pad has a flat surface facing a base of the cavity, and the flat surface directly contacts the fluid that pushes the at least one movable reamer pad out of the cavity.

10. A reamer assembly, comprising:

a housing configured to be coupled to a drill string uphole of a drill bit of the drill string, the housing defining a cavity configured to receive fluid from the drill string;

at least one movable rib configured to be at least partially disposed within the cavity, and a first valve configured to be coupled to an inlet of the cavity, the valve operable to regulate, as a function of feedback from one or more sensors of the drill string, a flow of fluid into the cavity;

wherein the cavity comprises a volume defined between a lower surface of the movable rib and a bottom surface of the cavity, and the valve allows the fluid to enter and fill the cavity underneath the reamer, contacting the at least one movable rib while expanding the volume, allowing the fluid to contact and push the at least one movable rib out of the cavity to increase a reaming diameter of the at least one movable rib; and wherein the valve maintains, with the movable rib pushed out of the cavity, the fluid within the volume;

wherein the drilling assembly further comprises a second valve fluidly coupled with the cavity and configured to regulate a fluid pressure in the cavity.

11. The reamer assembly of claim 10, further comprising a controller operationally coupled to the valve, the controller configured to control, as a function of feedback from the one or more sensors, the valve to regulate the flow of fluid into the cavity.

12. The reamer assembly of claim 11, wherein the reamer assembly is coupled to a system comprising one or more computers in one or more locations, the system electrically coupled to the one or more sensors and configured to:

receive feedback from the sensors, determine, based on the sensor feedback, a dogleg severity of the wellbore, determine, based on the determined dogleg severity, a command, and transmit the command to the controller for the controller to control the valve to regulate the flow of fluid into the cavity and move the at least one reamer pad to the first position or the second position.

13. A method, comprising:

receiving, by a system comprising one or more computers in one or more locations, sensor feedback from one or more sensors coupled to a drill string disposed within a wellbore;

determining, by the system and as a function of the sensor feedback, controller instructions; and transmitting, by the system and to a controller operationally coupled to a valve coupled to a cavity of a reamer assembly comprising a movable rib, the controller instructions, causing the controller to open the valve and allow fluid to enter and fill the cavity underneath the reamer, contacting the movable rib while expanding a volume defined between a lower surface of the movable rib and a bottom surface of the cavity, allowing the fluid to contact and push the at least one movable rib out of the cavity to increase a reaming diameter of the at least one movable rib to ream the wellbore, wherein the controller controls the valve such that the valve maintains, with the movable rib pushed out of the cavity, the fluid within the volume at a pressure regulated by a second valve fluidly coupled with the cavity to regulate a flow of fluid out of the fluid cavity.

14. The method of claim 13, further comprising:

determining, by the system and based on the sensor feedback, a dogleg severity of the wellbore, determining, by the system and based on the determined dogleg severity, second instructions, and transmitting, by the system and to the controller, the second instructions for the controller to control the valve to regulate the flow of fluid into the cavity.

15. The method of claim 14, wherein the controller is configured to selectively expand the at least one reamer pad to two or more positions by controlling the valve to allow a predetermined amount of fluid into the cavity, and transmitting the second instructions comprises transmitting instructions to open the valve a predetermined amount associated with the dogleg severity.

16. The method of claim 15, wherein the controller is configured to selectively expand the at least one reamer pad to form a plurality of reaming diameters between a retracted position and an expanded position.

17. A drilling assembly, comprising:

a drill string comprising a drill bit configured to drill a wellbore, the drill string forming, with the drill string disposed within the wellbore, an annulus defined between an outer wall of the drill string and the wall of the wellbore;

one or more sensors configured to be coupled to the drill string, the one or more sensors configured to detect at least one parameter of the drill string or of the wellbore;

a reamer assembly configured to be coupled to the drill string uphole of the drill bit, the reamer assembly comprising:

a housing defining a cavity arranged to receive fluid from the drill string, at least one movable reamer pad configured to be at least partially disposed within the cavity, and a valve configured to be coupled to the housing, the valve operable to regulate, as a function of feedback from the one or more sensors, a flow of fluid into the cavity, allowing the fluid to enter the cavity underneath the reamer and contact the at least one movable reamer, allowing the fluid to fill a volume of the cavity and push the at least one movable reamer pad out of the cavity from a first position, in which the at least one reamer pad is retracted and the reamer assembly defines a first reaming diameter, to a second position in which the at least one reamer pad is expanded and the reamer assembly defines a second reaming diameter greater than the first reaming diameter;

wherein the valve is disposed along a fluid conduit formed in a wall of the housing, the fluid conduit extending from a bore of the housing to the cavity;

and wherein the drilling assembly further comprises a second fluid conduit extending from the cavity to an outer surface of the housing, the reamer assembly further comprising a second valve disposed at the second fluid conduit and configured to regulate a fluid pressure in the cavity by regulating a flow of fluid out of the fluid cavity and into the annulus.

18. A drilling assembly, comprising:

a drill string comprising a drill bit configured to drill a wellbore, the drill string forming, with the drill string disposed within the wellbore, an annulus defined between an outer wall of the drill string and the wall of the wellbore;

one or more sensors configured to be coupled to the drill string, the one or more sensors configured to detect at least one parameter of the drill string or of the wellbore; and a reamer assembly configured to be coupled to the drill string uphole of the drill bit, the reamer assembly comprising:

a housing defining a cavity arranged to receive fluid from the drill string, at least one movable reamer pad configured to be at least partially disposed within the cavity, and a valve configured to be coupled to the housing, the valve operable to regulate, as a function of feedback from the one or more sensors, a flow of fluid into the cavity, allowing the fluid to enter the cavity underneath the reamer and contact the at least one movable reamer, allowing the fluid to fill a volume of the cavity and push the at least one movable reamer pad out of the cavity from a first position, in which the at least one reamer pad is retracted and the reamer assembly defines a first reaming diameter, to a second position in which the at least one reamer pad is expanded and the reamer assembly defines a second reaming diameter greater than the first reaming diameter;

wherein the volume is defined between a lower surface of the reamer pad and a base of the cavity, and the valve maintains, with the reamer pad expanded, the fluid within the volume;

wherein the valve is disposed along a fluid conduit formed in a wall of the housing, the fluid conduit extending from a bore of the housing to the cavity.

19. The drilling assembly of claim 18, wherein the fluid conduit resides underneath the cavity.

* * * * *